US011050171B2

(12) United States Patent
Wu

(10) Patent No.: US 11,050,171 B2
(45) Date of Patent: Jun. 29, 2021

(54) TERMINAL BLOCK STRUCTURE

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 0 days.

(21) Appl. No.: 16/940,128

(22) Filed: Jul. 27, 2020

(65) Prior Publication Data

US 2021/0005988 A1 Jan. 7, 2021

Related U.S. Application Data

(63) Continuation of application No. 16/502,916, filed on Jul. 3, 2019, now Pat. No. 10,770,809.

(51) Int. Cl.

| | |
|---|---|
| ***H01R 9/24*** | (2006.01) |
| ***H01R 4/48*** | (2006.01) |
| *H01R 9/26* | (2006.01) |
| *H01R 4/22* | (2006.01) |
| *H01R 12/51* | (2011.01) |

(52) U.S. Cl.

CPC ..... *H01R 9/2416* (2013.01); *H01R 4/4836* (2013.01); *H01R 4/4845* (2013.01); *H01R 4/22* (2013.01); *H01R 4/4818* (2013.01); *H01R 4/4827* (2013.01); *H01R 9/24* (2013.01); *H01R 9/26* (2013.01); *H01R 9/2616* (2013.01); *H01R 12/515* (2013.01)

(58) Field of Classification Search

CPC .. H01R 4/4827; H01R 4/4818; H01R 4/4836; H01R 4/22; H01R 12/515; H01R 4/4845; H01R 9/2416; H01R 9/24; H01R 9/2616; H01R 9/26

See application file for complete search history.

(56) References Cited

U.S. PATENT DOCUMENTS

| | | | | |
|---|---|---|---|---|
| 9,905,943 | B2 * | 2/2018 | Herrmann | H01R 4/4818 |
| 2002/0187670 | A1 * | 12/2002 | Cisey | H01R 9/2666 439/441 |

* cited by examiner

*Primary Examiner* — Abdullah A Riyami
*Assistant Examiner* — Justin M Kratt
(74) *Attorney, Agent, or Firm* — Chun-Ming Shih; HDLS IPR Services

(57) ABSTRACT

A terminal block includes an insulative body, a conductive member, an elastic sheet and a pressing member. The insulative body has a receiving room therein and is formed with a pressing hole and a wire hole, which separately communicate with the receiving room. The conductive member is received in the receiving room and has a seat and a contact portion tilted up from the seat. The elastic sheet is received in the receiving room. An end of the elastic sheet is in contact with the conductive member. The pressing member is disposed in the pressing hole and capable of moving toward the receiving room to push another end of the elastic member. The pressing member has a placement slot. Each of two sides of the placement slot has a blocking wall.

7 Claims, 8 Drawing Sheets

TERMINAL BLOCK STRUCTURE

CROSS-REFERENCE TO RELATED APPLICATIONS

This application is a continuation application of U.S. application Ser. No. 16/502,916 filed on Jul. 3, 2019. The entire disclosure is incorporated herein by reference.

BACKGROUND OF THE INVENTION

Technical Field

The invention relates to electric connectors, particularly to an improved terminal block structure.

Related Art

A terminal block is an electric component used in machines or devices with requirements of connecting electric apparatuses. It can used to connect power cords, control lines or data transmission lines.

Usually, a conventional terminal block is composed of a body and an elastic sheet assembled thereto. The body and the elastic sheet are assembled by riveting or engagement. Besides the elastic sheet or a conductive terminal, a metal cap is usually needed to prevent a wire from laterally escaping from the body when the wire is fixed. Thus, material and assembling costs will be increased. This is an issue to be solved.

SUMMARY OF THE INVENTION

An object of the invention is to provide an improved terminal block structure, which can fasten a wire by existing components without an additional cap to save manufacturing costs.

To accomplish the above object, the invention is to provide an improved terminal block structure, which includes an insulative body, a conductive member, an elastic sheet and a pressing member. The insulative body has a receiving room therein and is formed with a pressing hole and a wire hole, which separately communicate with the receiving room. The conductive member is received in the receiving room and has a seat and a contact portion tilted up from the seat. The elastic sheet is received in the receiving room. An end of the elastic sheet is in contact with the conductive member. The pressing member is disposed in the pressing hole and capable of moving toward the receiving room to push another end of the elastic member. The pressing member has a placement slot. Each of two sides of the placement slot having a blocking wall. The wire is inserted into the wire hole to pass through the placement slot and is pushed by the another end of the elastic member to be in contact with the contact portion.

DETAILED DESCRIPTION OF THE INVENTION

Figure 1:
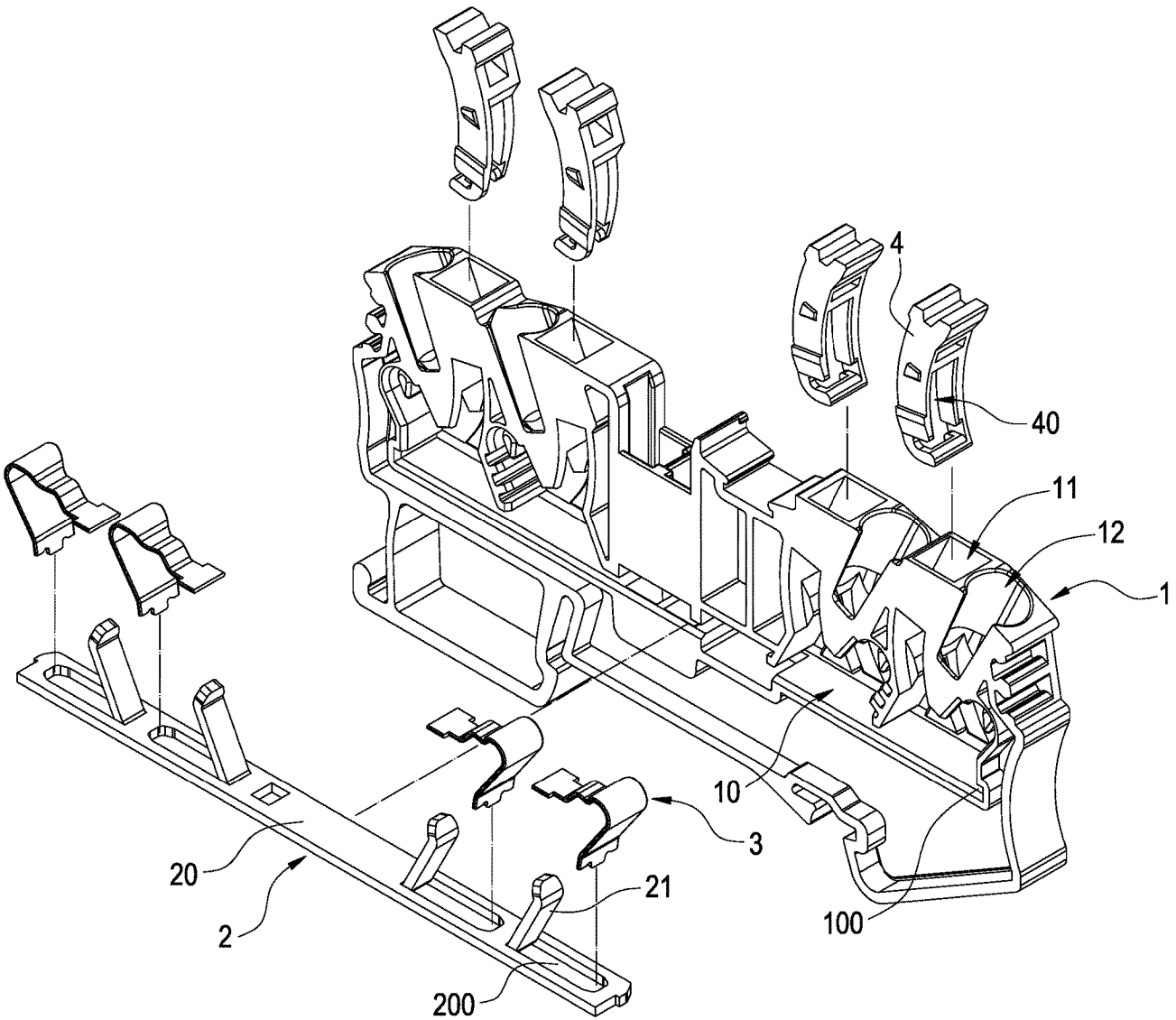
FIG. 1 is an exploded view of the invention.

Please refer to FIG. 1, which is an exploded view of the invention. The invention provides an improved terminal block structure for being inserted by a wire 5 to make electric connection, which includes an insulative body 1, a conductive member 2, an elastic sheet 3 and a pressing member 4.

A size of the insulative body 1 can be varied depending upon the number of the wires 5 to be inserted. Also, both the elastic sheet 3 and the pressing sheet 3 can be increased depending upon the number of the wires 5. In the embodiment of the invention, the insulative body 1 is a long flat body and allows the wires 5 to be inserted into a longitudinal side thereof. For the sake of conciseness, only one wire is depicted. The insulative body 1 has a receiving room 10 therein. The receiving room 10 is formed in a side of the insulative body 1. The insulative body 1 is formed with a pressing hole 11 and a wire hole 12. The wire hole 12 is used to be inserted by the wire 5.

Figure 2:
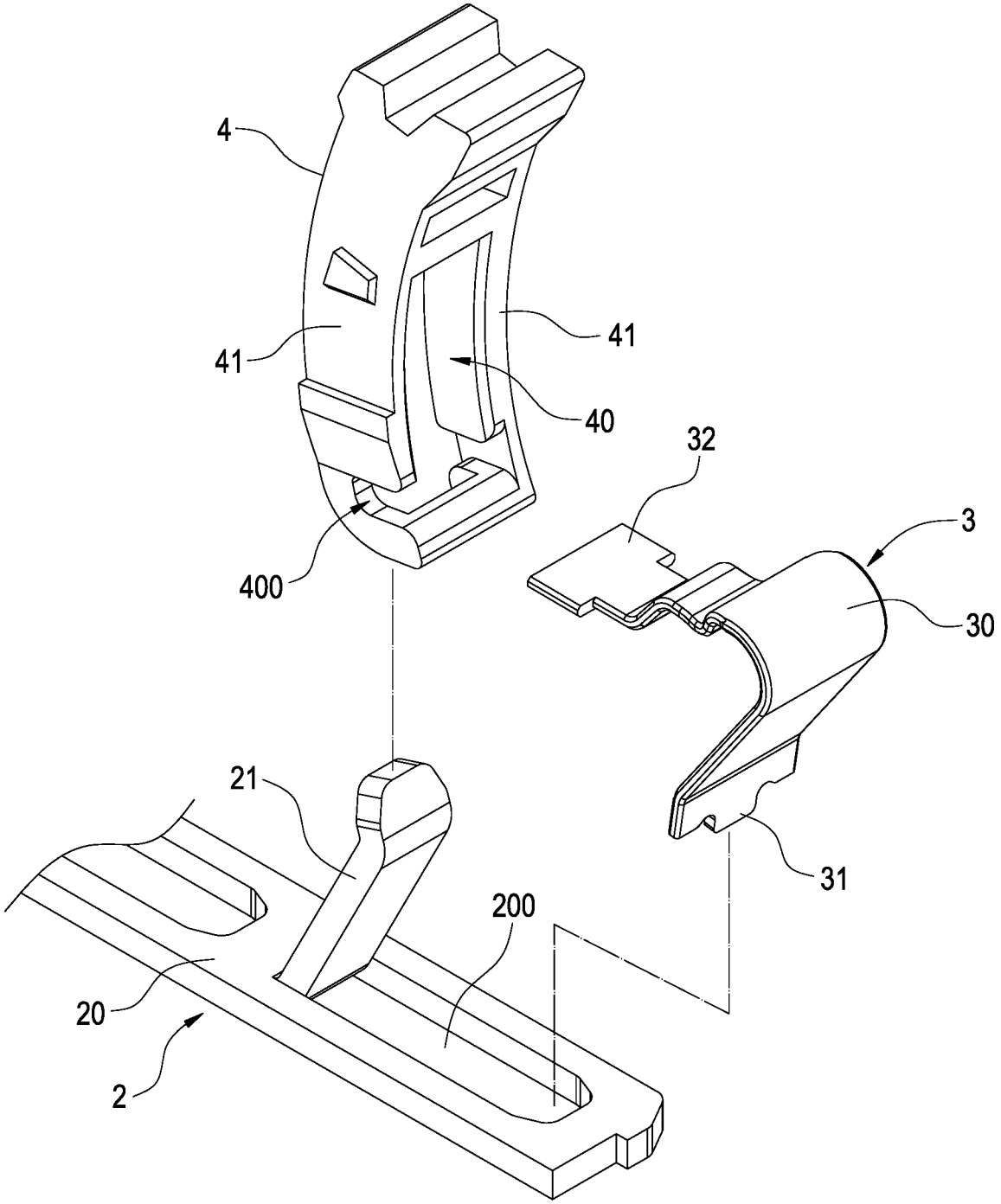
FIG. 2 is an exploded view of the conductive member, elastic sheet and pressing member of the invention.
Figure 3:
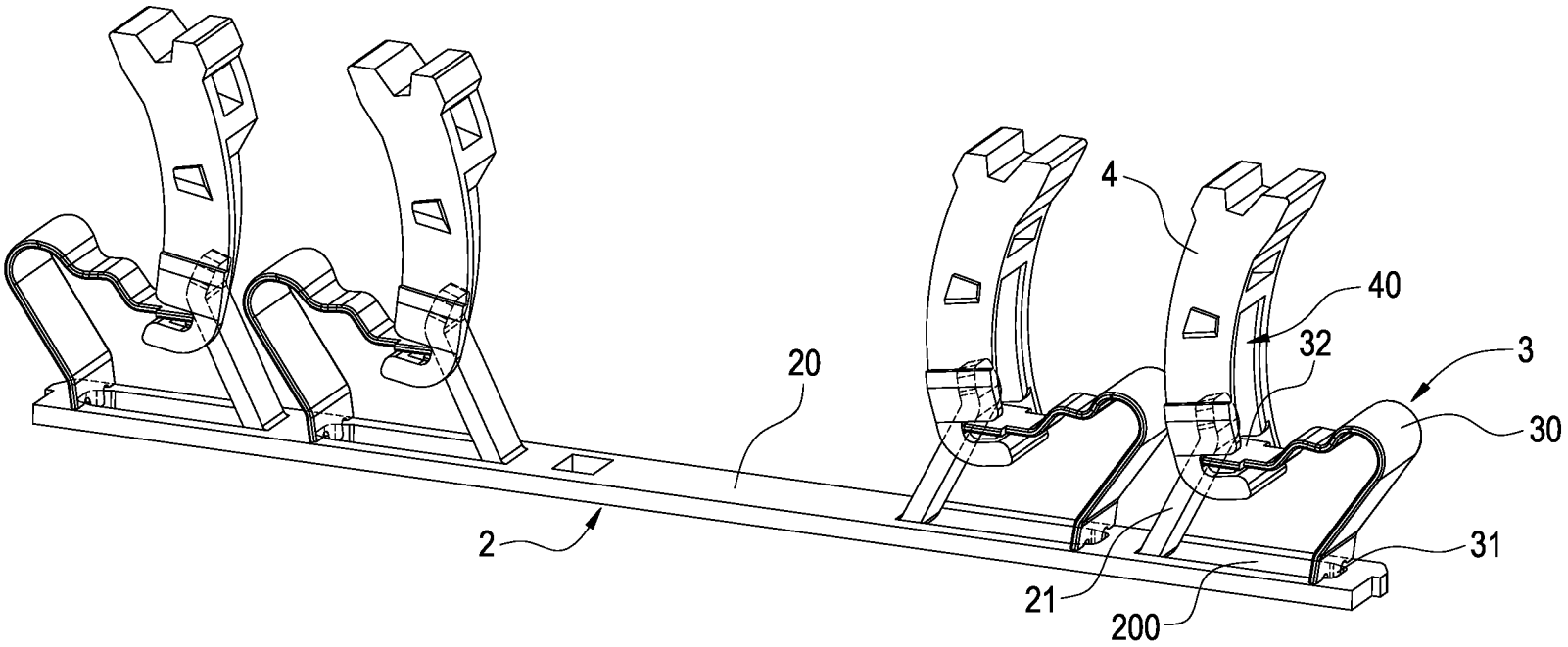
FIG. 3 is an assembled view of the conductive member, elastic sheet and pressing member of the invention.

Please refer to FIGS. 2 and 3. The conductive member 2 is formed by pressing a metal piece and received in the received room 10. The conductive member 2 has a seat 20 and a contact portion 21 tilted up from the seat 20. The contact portion 21 corresponds to the wire hole 12 of the insulative body 1. In this embodiment, the contact portion 21 is formed by punching a material hole 200 in the seat 20 and bending it upward. The number of the contact portion 21 may correspond to the number of the wire 5 to be multiple. In addition, a side of the receiving room 10 of the insulative body 1 may be formed with a notch 100 for being embedded by an end of the seat 20 to be positioned.

The elastic sheet 3 is received in the receiving room 10. An end of the elastic sheet 3 is in contact with the conductive member 2. The pressing member 4 is disposed in the pressing hole 11 and capable of moving toward the receiving room 10 to push another end of the elastic member 3. In this embodiment, the elastic sheet 3 has an elastic portion 30, a first end 31 extending from an end of the elastic portion 30 and a second end 32 extending from another end of the elastic portion 30. The first end 31 is fastened into the material hole 200 of the seat 20 and the second end 32 is fastened with the pressing member 4.

Figure 4:
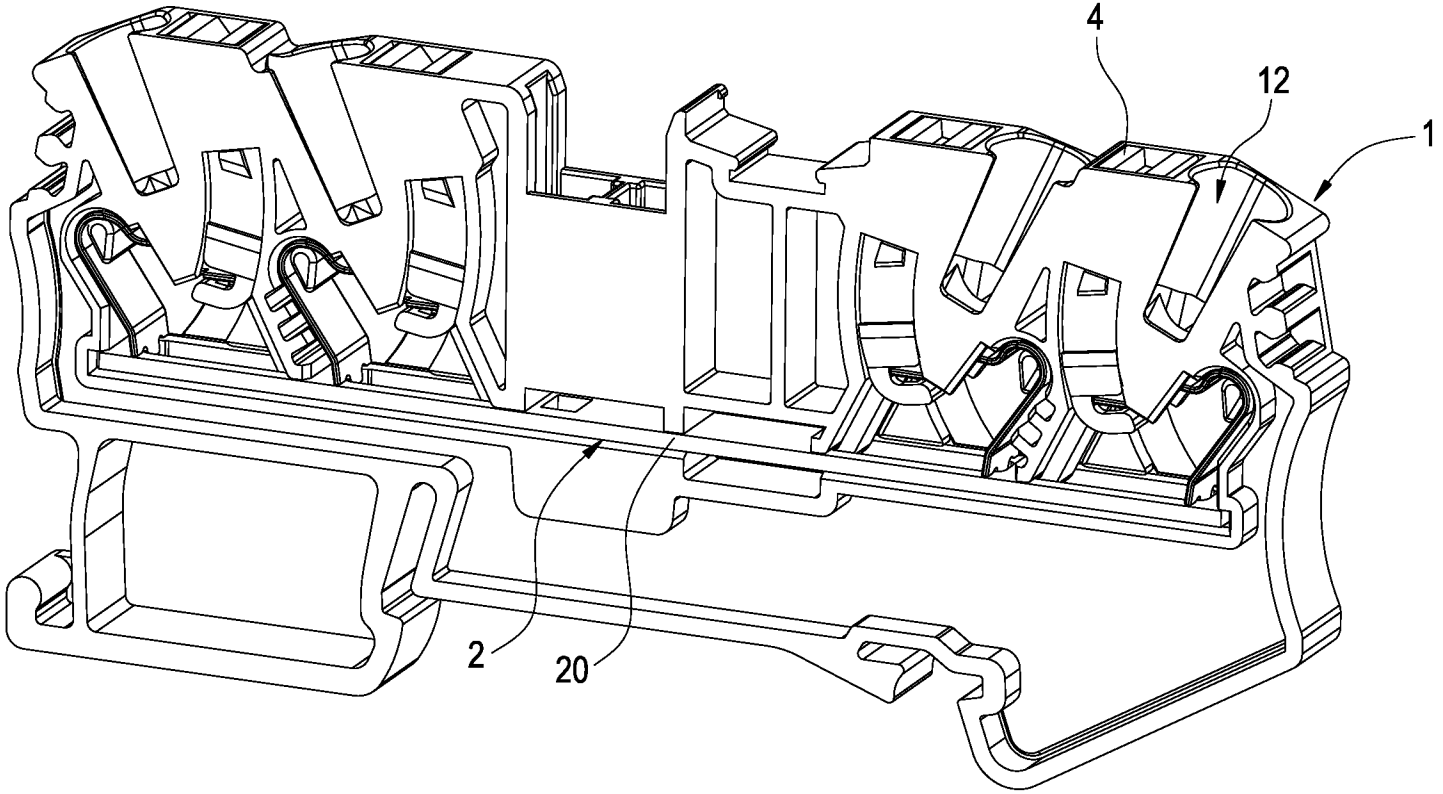
FIG. 4 is an assembled view of the invention.

Please further refer to FIG. 2. The pressing member 4 is provided with a placement slot 40 to which the contact portion 21 is directed as shown in FIG. 3. Each of two sides of the placement slot 40 has a blocking wall 41. In addition, a lower end of the placement slot 40 is formed with an engaging trench 400 for being inserted by the second end 32 of the elastic sheet 3. The engaging trench 400 may be greater than the placement slot 40 in width. The engaging trench 400 in one of the blocking walls 41 is open to allow the second end 32 of the elastic 3 to be placed in to form an assembled status as shown in FIG. 4.

By the abovementioned structure, the improved terminal block structure of the invention can be obtained.

Figure 5:
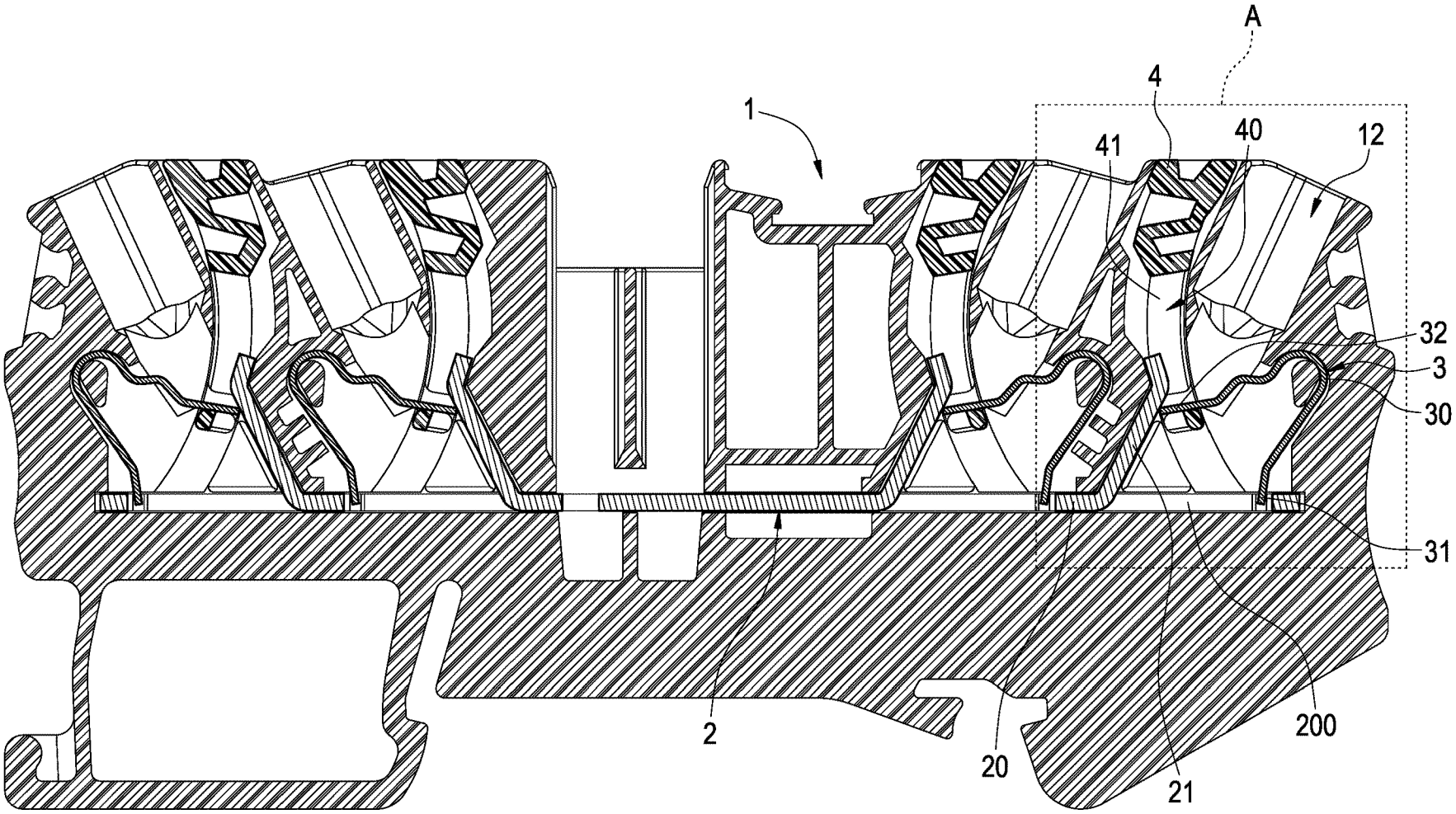
FIG. 5 is a cross-section view of the invention.
Figure 6:
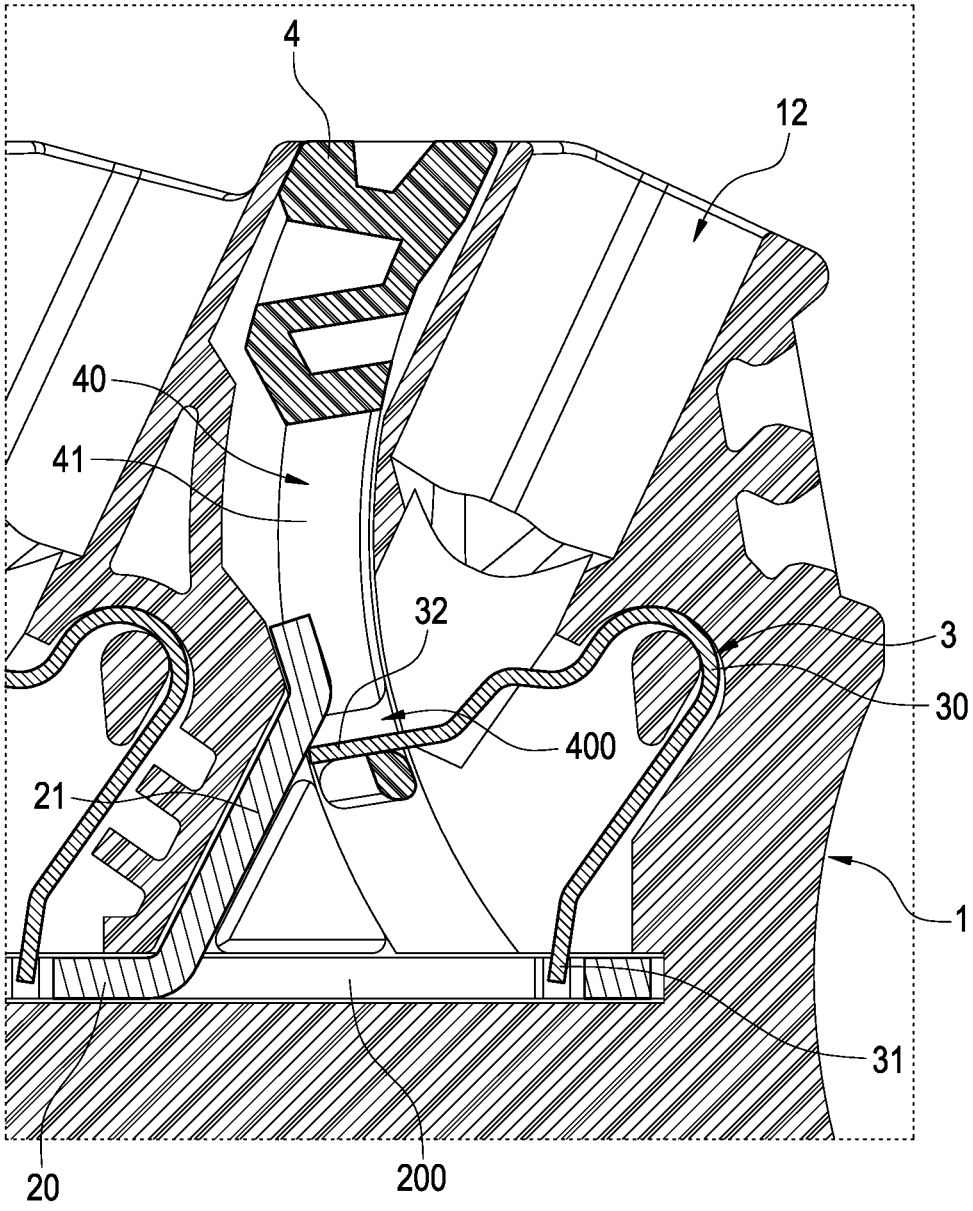
FIG. 6 is an enlarged view of part A in FIG. 5.
Figure 7:
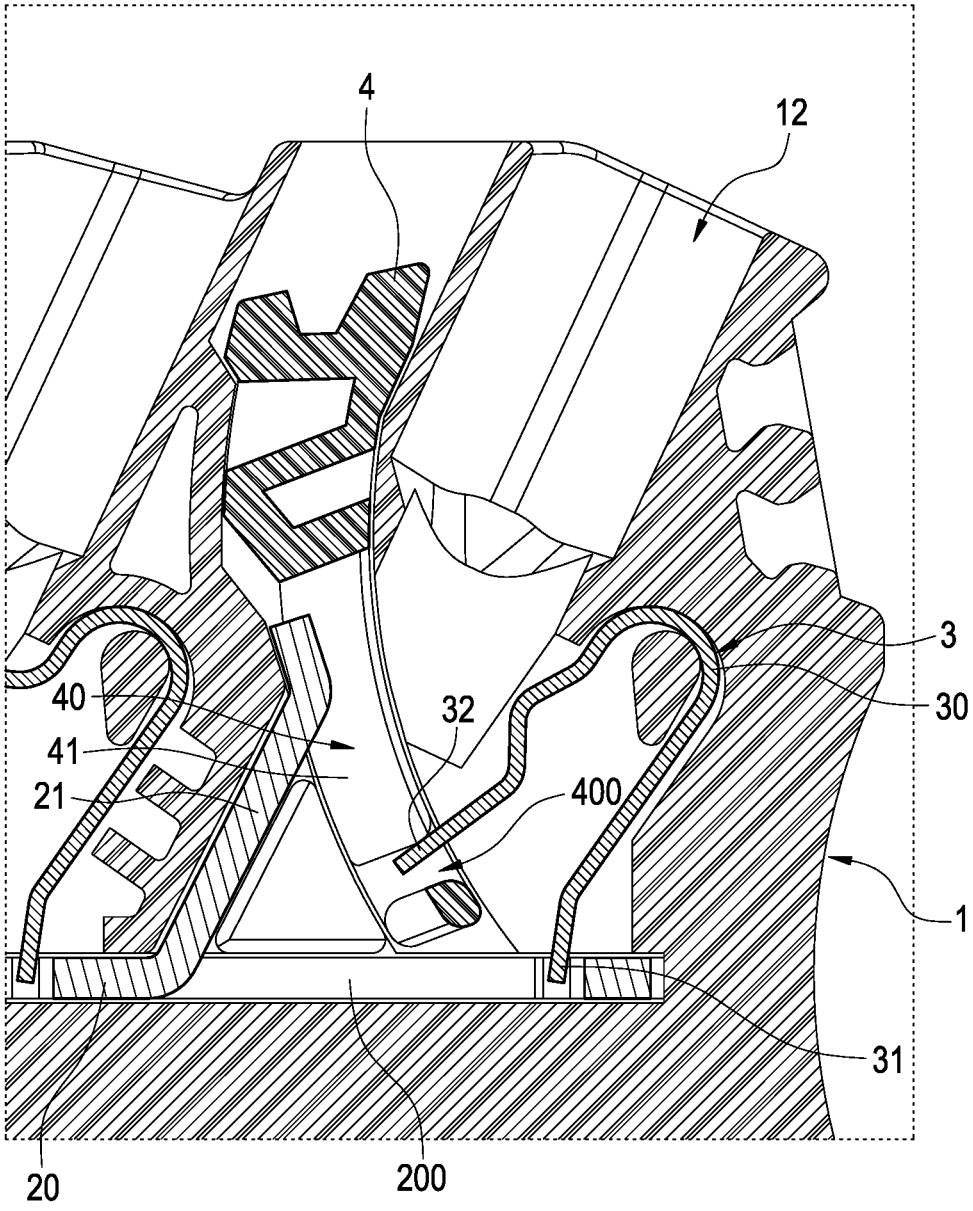
FIG. 7 is a schematic view of operation of the pressing member according to FIG. 6.
Figure 8:
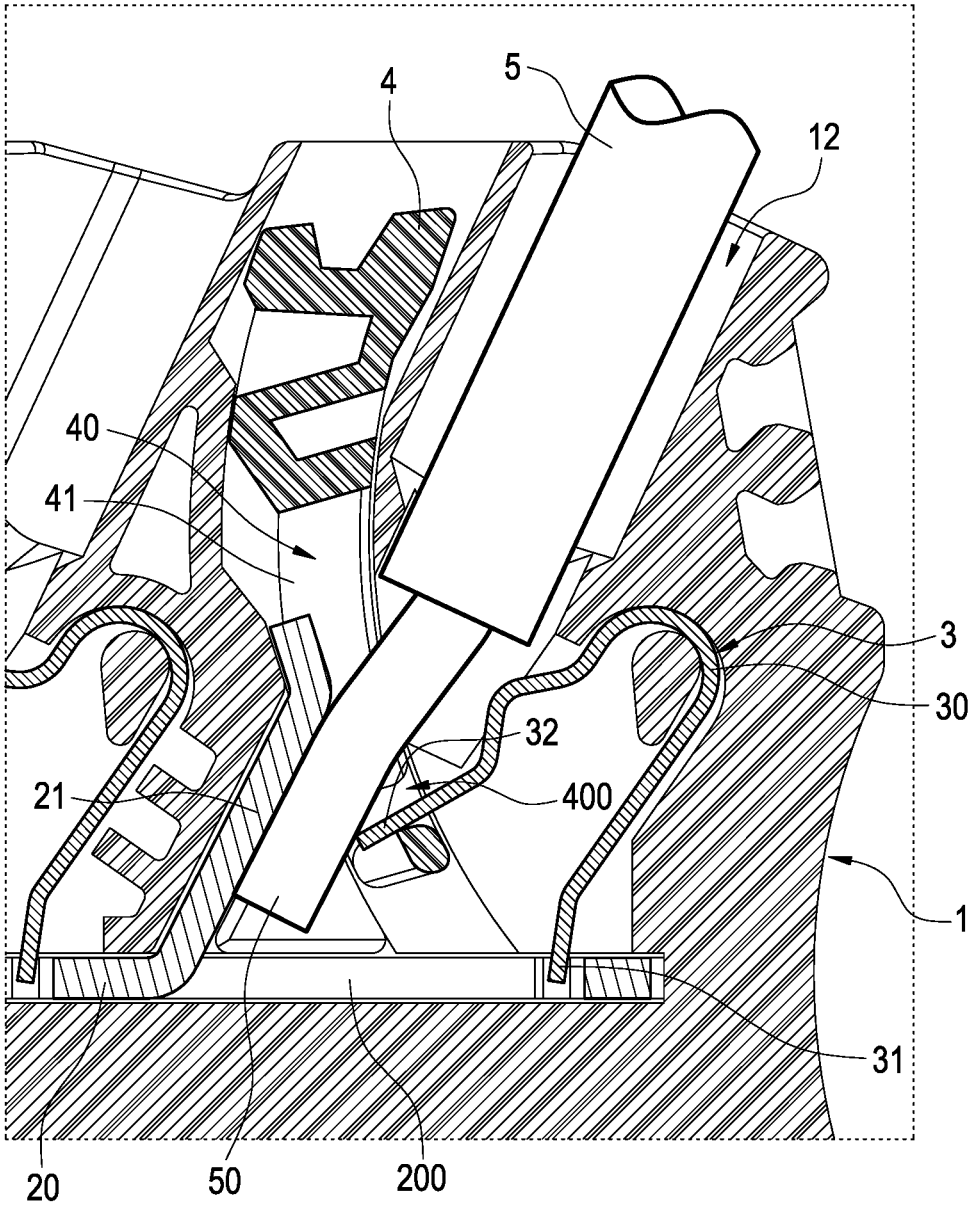
FIG. 8 is a schematic view of operation of inserting a wire according to FIG. 7.

Accordingly, as shown in FIGS. 5 and 6, before the wire 5 is not inserted yet, the pressing member 4 is pushed upward by the second end 32 of the elastic sheet 3 not to completely enter the receiving room 10. As shown in FIG. 7, before inserting the wire 5, the pressing member 4 should be pushed toward the receiving room 10 to move the second end 32 of the elastic sheet 3 to make the placement slot 40 enter the receiving room 10. Next, as shown in FIG. 8, the wire 5 can be inserted into the wire hole 12 to pass through the placement slot 40 to be beside the contact portion 21. After releasing the pressing member 4, a wire core 50 of the wire 5 can be pressed by the second end 32 of the elastic member 3 by elasticity of the elastic portion 30. As a result, the wire core 50 can be in contact with the contact portion 21 to make electric connection.

Therefore, in the present invention, after inserting the wire 5, it is restricted in the placement slot 40 by the pressing member 4 so that the wire 5 can be firmly fastened without an additional cap to save manufacturing costs.

It will be appreciated by persons skilled in the art that the above embodiment has been described by way of example only and not in any limitative sense, and that various alterations and modifications are possible without departure from the scope of the invention as defined by the appended claims.

What is claimed is:

1. A terminal block for being inserted by a wire, comprising:

an insulative body, having a receiving room therein, and formed with a pressing hole and a wire hole, which separately communicate with the receiving room;

a conductive member, received in the receiving room, and having a seat and a contact portion tilted up from the seat;

an elastic sheet, received in the receiving room, and an end of the elastic sheet being in contact with the conductive member; and a pressing member, disposed in the pressing hole, capable of moving toward the receiving room to push another end of the elastic sheet, having a placement slot, and each of two sides of the placement slot having a blocking wall, wherein the blocking wall is a side wall of the pressing member so two side walls sandwich the placement slot;

wherein the wire is inserted into the wire hole to pass through the placement slot and to be sandwiched between two blocking walls while moving the pressing member toward the receiving room to push the another end of the elastic sheet, and the wire is pushed by the another end of the elastic sheet to be in contact with the contact portion.

2. The terminal block of claim 1, wherein the insulative body is a long flat body, and the receiving room is formed in a side of the insulative body.

3. The terminal block of claim 1, wherein the receiving room of the insulative body is formed with a notch for being embedded by an end of the seat to be positioned.

4. The terminal block of claim 1, wherein the conductive member is formed by pressing a metal piece, and the contact portion is formed by punching a material hole in the seat and bending upward.

5. The terminal block of claim 1, wherein the contact portion is directed toward the placement slot to correspond to the wire hole.

6. The terminal block of claim 1, wherein the elastic sheet has an elastic portion, a first end extending from an end of the elastic portion and a second end extending from another end of the elastic portion, the first end is in contact with the conductive member, and the second end is fastened with the pressing member.

7. The terminal block of claim 6, wherein a lower end of the placement slot has an engaging trench for receiving the second end.

* * * * *